US005885427A

United States Patent [19]

Pickering et al.

[11] Patent Number: 5,885,427

[45] Date of Patent: Mar. 23, 1999

[54] CAST IRON ANODE AND METHOD OF MAKING

[75] Inventors: Ian Pickering, Stockton-On-Tees; John Chase, Guisborough, both of United Kingdom

[73] Assignee: Corrpro Companies, Inc., Medina, Ohio

[21] Appl. No.: 873,654

[22] Filed: Jun. 12, 1997

[51] Int. Cl.[6] ..... C25B 11/04

[52] U.S. Cl. ..... 204/293; 204/280; 204/287; 204/292; 204/196; 204/197; 29/825; 29/854; 29/855; 29/857; 29/858; 29/422; 29/527.5; 29/745; 29/746; 29/747; 164/397; 164/398; 164/399; 164/351; 164/361; 164/369; 164/370

[58] Field of Search ..... 204/196, 197, 204/280, 287, 292, 293; 29/825, 854, 855, 857, 858, 422, 527.5, 745–747; 164/47, 459, 464, 465, 488, 397, 398, 399, 351, 361, 369, 370

[56] References Cited

U.S. PATENT DOCUMENTS

| | | | |
|---|---|---|---|
| 3,326,791 | 6/1967 | Heuze | 204/196 |
| 3,471,395 | 10/1969 | Sumner | 204/196 |
| 4,096,051 | 6/1978 | Annis, Jr. et al. | 204/196 |
| 4,265,725 | 5/1981 | Tatum | 204/196 |
| 4,515,669 | 5/1985 | Dimond et al. | 204/196 |
| 4,832,107 | 5/1989 | Hass et al. | 164/98 |
| 5,090,924 | 2/1992 | Pfaller et al. | 439/807 |
| 5,185,921 | 2/1993 | Pfaller et al. | 29/825 |

*Primary Examiner*—Bruce F. Bell
*Attorney, Agent, or Firm*—Renner, Otto, Boisselle, Sklar

[57] ABSTRACT

A solid high silicon cast iron elongated anode has a midpoint electrical connection keeping the connection as far as possible from the ends to combat the deleterious pencil effect. The anode is made by casting using a hollow or shell core to form a small axial hole extending from one end. The sand or foundry material of the core is removed and the wall of the hole at the blind end of the hole is at least partially finished to receive a diagonally split slug to which a lead wire is connected. Alternatively the hole is formed by a steel pipe which is left in place as a hole liner. The pipe may be supported by one or more chaplets. The slug is fastened in the blind end of the hole by a driving tool rotating a threaded headed bolt with both axial and rotational force to hold the connection in the blind end of the hole as it is secured in place. The hole is filled with a potting compound sealing the connection in the center of the solid cast iron anode.

27 Claims, 1 Drawing Sheet

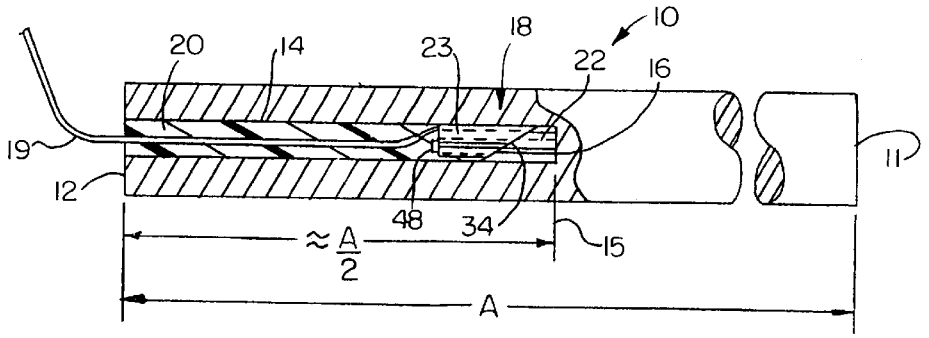
FIG. 1
FIG. 6
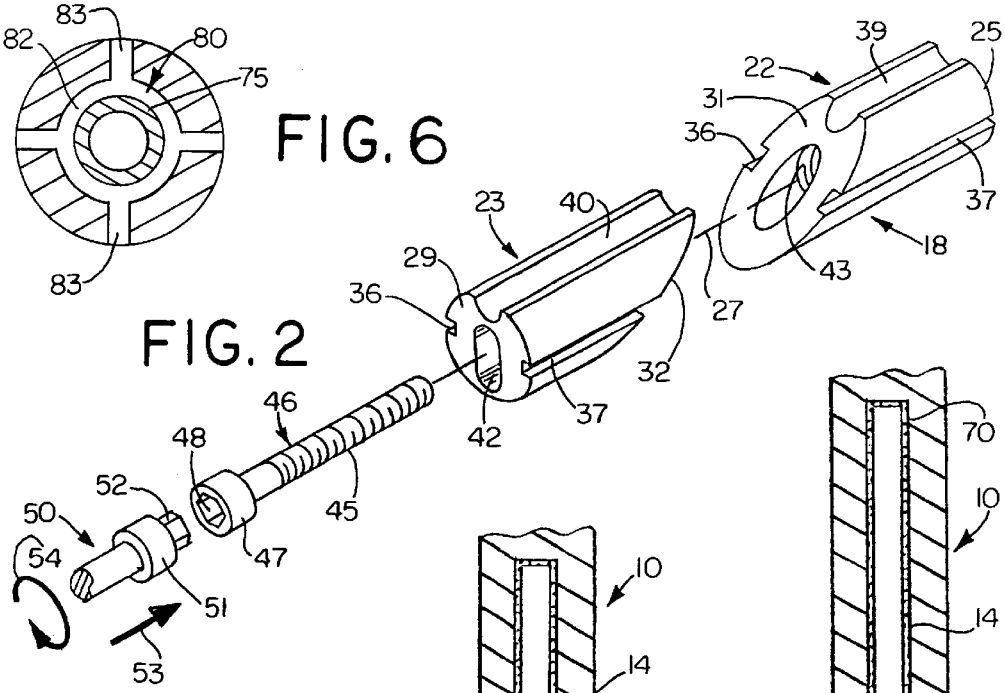
FIG. 2
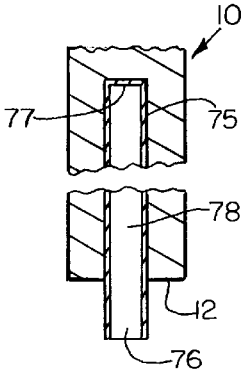
FIG. 5
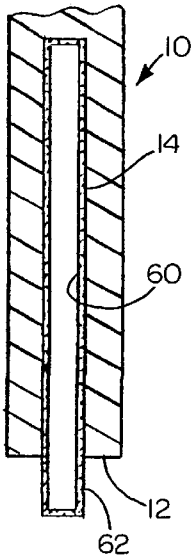
FIG. 3
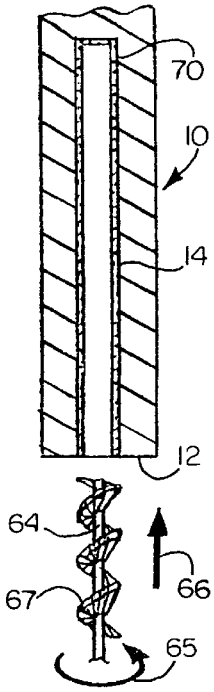
FIG. 4

CAST IRON ANODE AND METHOD OF MAKING

DISCLOSURE

This invention relates generally to a cast iron anode and method of making, and more particularly to a solid high silicon cast iron anode having a midpoint electrical connection, and a method of making such anode economically.

BACKGROUND OF THE INVENTION

Impressed current anodes are made from a variety of materials such as graphite, titanium, or high silicon cast iron. High silicon cast iron is a particularly effective material and is widely used in impressed current cathodic protection systems. The cast iron anodes may be of substantial length and are usually in tubular or solid form. Elongated anodes suffer from a phenomena known as "pencil effect" or "end effect". The anodes are, of course, designed to corrode rather than the structure being protected. With the pencil effect the anode corrosion occurs at each end in effect sharpening each end progressively as a pencil. The pencilling continues throughout the service life of the anode usually until the progressive corrosion meets the electrical connection to the anode. When the electrical connection fails, the anode is no longer effective.

Solid anodes can be more effective and have a longer service life primarily because of the greater mass of cast iron material involved. Tubular high silicon cast iron anodes can be rotationally cast much like a section of cast iron pipe. Solid anodes usually require sand or special molds and patterns. Another problem with solid high silicon cast iron anodes is that unlike graphite or other metals they are quite brittle and cannot be economically drilled to any significant extent. For this reason electrical connections for solid elongated sizable high silicon cast iron anodes are usually cast into the anode near one end, and the pencilling or end effect reduces the service life of the anode. An example of such a connection is seen in Sumner U.S. Pat. No. 3,471,395. Such patent also discloses a complex heat shrinkable fluorocarbon sheath surrounding the connection end and a plastic end cap, all designed to provide added protection to the connection. It would, of course, be desirable in an anode of the type shown in Sumner to have the connection at approximately the midpoint of the anode end-to-end.

Providing a midpoint or center connection is relatively easy in tubular cast iron anodes such as seen in Bushman U.S. Pat. No. 4,515,669 or in tubular titanium anodes such as seen in Pfaller et al. U.S. Pat. No. 5,185,921. However, where the connection is to be positioned at the bottom or blind end of a fairly deep hole, complex apparatus is usually required. An example is seen in Tatum U.S. Pat. No. 4,265,725 where a hydraulic cylinder assembly and frame are required with the frame being longer than the anode, the cylinder, and the stroke of the cylinder. For an anode of substantial length an overhead crane may be required to assemble the parts.

It would accordingly be desirable to have a solid elongated cast iron anode with a reliable midpoint connection, and one with a connection which can easily be made to be seated in the bottom or blind end of a small hole extending from one end.

SUMMARY OF THE INVENTION

A solid high silicon cast iron anode is formed by a process using a shell or hollow core to form a relatively small hole in one end and which core is augured or cleaned out after casting using a tough abrasive tool which not only removes the core but also partially finishes the interior of the hole especially adjacent the blind end of the hole. The hole may also be formed by a steel pipe or tube left in place and around which the anode is cast. For long anodes, one or more chaplets or inserts may be employed to maintain the pipe centered. The pipe projects from the end of the mold, and the protrusion may be trimmed off after casting. The hole has a depth of about half the length of the anode. After the hole is prepared an electrical connection is formed in the bottom or blind end of the hole. The connection is preferably formed by a small slug diagonally split. A bare tip of an insulated lead wire is soldered or brazed to the exterior of the outer of the split parts and a threaded recessed head hex bolt is threaded in the inner split part and extends through a radial slot in the outer split part. A driving tool urges the bolt and the inner or one split part against the blind end of the hole. Rotation of the tool advances the outer or other part of the slug along the diagonal split to drive the soldered or brazed lead against the finished or semi-finished interior of the blind hole at about the midpoint of the anode. The hole is then filled with a suitable dielectric potting compound to seal the connection with the insulated lead wire projecting from the potting compound at the end of the anode.

In this manner the pencil or effect will not shorten the service life of the anode. The anode with the method disclosed is thus more economical to manufacture yet provides an anode having a longer and more effective service life.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIG. 1 is a broken partially in section elevation illustrating the assembled anode;

FIG. 2 is an exploded view of the electrical connection slug and the driving tool.

FIG. 3 is a sectional view of the anode casting with the shell core in place; and FIG. 4 is a similar view illustrating the shell core about to be removed and the hole finished;

FIG. 5 is a similar view of the anode being formed with a steel pipe left in place forming the hole; and FIG. 6 is a transverse section through a chaplet or insert used with long anodes to maintain the pipe centered.

DETAILED DESCRIPTION OF THE PREFERRED EMBODIMENTS

Referring initially to FIG. 1 there is illustrated generally at 10 a solid elongated high silicon cast iron anode in accordance with the present invention. The anode has an elongated cylindrical body with a length A which may vary widely from about 2' to 5' or more. The transverse shape of the anode is usually cylindrical having a relatively small diameter. Although the dimensions may vary widely, a typical dimension would be a length of 5' or more and a diameter of approximately 2" or more.

The anode has an end 11, and an opposite end 12. A relatively small diameter hole shown at 14 extends from the opposite end 12 to the approximate midpoint of the anode shown at 15. The distance from the opposite end 12 to the midpoint 15 is approximately half of the length of the anode as illustrated by the A dimension.

The blind end of the hole 14 shown at 16 serves as a seat for an electrical connection shown generally at 18. The electrical connection includes an insulated electrical lead 19 extending through the hole 14, and a dielectric potting compound such as an epoxy or other suitable sealant indicated at 20 completely fills the hole to the end 12 sealing the connection 18 in the center of the anode. The insulated electrical lead is the only thing projecting from the hole. No special cap or other sealant on the opposite end 12 of the anode need be provided.

Referring now to FIG. 2 it will be seen that the connection 18 is formed from a two part diagonally split slug, one inner part being indicated at 22 while the other outer part is indicated at 23. The slug parts are formed of a conductive metal such as bronze, brass, or other suitable conductive alloys. The one part has a circular end face 25 which is adapted to abut the bottom or blind end 16 of the hole 14. The face 25 extends at right angles to the axis of the hole and the slug parts, which axis is shown at 27. Similarly, the end facing the viewer of the other slug part 23 seen at 29 is circular and at right angles to the axis. However, the faces of the slug parts at the diagonal split are oval as seen at 31 and 32 for the parts 22 and 23, respectively. The diagonal split formed by such faces is shown at 34 in FIG. 1. The two slug parts 22 and 23 each have diametrically opposite grooves seen at 36 and 37 which permit the potting compound to flow past and around the connector slug parts completely to seal the slug within the blind end of the hole. The slug parts also each have a semi-circular groove as seen at 39 and 40, respectfully, which are aligned at the small end of the elliptical or oval faces forming the split.

The other slug part 23 is formed with a diametrically elongated through-slot 42 while the one slug part 22 is formed with a threaded hole 43. The threads in the hole 43 match the threads 45 on bolt 46. The bolt 46 is provided with an enlarged cap 47 having an hexagonal drive socket 48. The bolt 46 thus extends through the diametrically elongated slot 42 and is threaded into the threaded hole 43. The bolt is driven by the driving tool indicated generally at 50. The driving tool includes a shoulder forming collar 51 and a hexagonal projection 52 which is received in the socket 48. The collar 51 thus bears against the cap 47 and the driving tool is able to exert an axial force in the direction of the arrow indicated at 53. Rotation as shown by the error 54 will thread the bolt into the threaded hole 43 with the cap 47 bearing against the face 29 as the bolt is tightened. Tightening of the bolt will cause the slug part 27 to move radially as the two parts move toward each other, such radial movement being obtained by the abutting split wedge surfaces 31 and 32 of the interface.

Before the connection is inserted in the hole and tightened, a bare end of the lead 19 is soldered or brazed in the groove 40. The bare end of the lead will project just proud of the circular configuration of the slug parts so that as the connection is tightened by both the axial and rotational force, the bare end of the lead is driven by the wedge surfaces against the interior wall of the hole at the blind end.

Referring now to FIGS. 3 and 4 it will be seen that the hole 14 may be formed by a shell core shown generally at 60. The core is hollow as indicated and projects through the mold parts forming the end 12 of the anode. Accordingly, when the cast iron anode is removed from the mold, the core may project from the wall as indicated at 62 and be easily broken off or removed. The projection of the core beyond the wall 12 assists in centering the core with respect to the mold and enables the core to be positioned in the precise center of the mold without the use of chaplets or at least an excess number of chaplets.

In order to remove the foundry sand or material forming the core and any binder from the hole 14, an aggressive abrasive tool is employed such as seen at 64 in FIG. 4. The tool is capable of rotation as indicated by the arrow 65 and also axial movement as indicated by the arrow 66. The tool may be in the form of an aggressive abrading tool having a spirally arranged flight of abrasive fingers seen at 67 which project like the auger of a screw. The fingers are slightly flexible and they have abrasive entrained therein. Insertion and rotation of the tool effectively removes the core from the hole and continued rotation of the tool against the blind end of the hole partially finishes the interior wall of the hole in the area indicated at 70 which is the area where the connection will be formed. Removal of the sand and debris from the core may be accompanied by a fluid flushing or washing. In any event the core is easily removed and in the process the interior of the hole is partially finished as well as cleaned.

In FIG. 5 there is illustrated another method of making the anode. The hole is formed by a steel pipe core illustrated at 75. The pipe 75 has a higher melting temperature than the cast iron. The pipe projects through the end 12 of the anode for centering and support purposes and after casting and removal, the projecting end may simply be sawn or trimmed off at the end 12. The end of the pipe is open as indicated at 76 and the interior may be fluid cooled during casting or provided with a heat sink which is removed after cooling. The pipe at the inner end is closed as seen at 77 and the end wall becomes the blind end of the hole at the midpoint of the anode body. The pipe forms a hole 78 extending axially and centered from the end 12 of the body to the midpoint. Even though the anode 10 has a steel pipe liner for the hole, it is nonetheless a solid cast iron anode.

As seen in FIG. 6, for long anodes one or more chaplets or inserts 80 may be employed to maintain the pipe centered in the mold. These chaplets or inserts are made of the same alloy as the anode. Each chaplet includes a ring 82 embracing the outside of pipe 75 and four quadrant spaced equal length arms 83 to engage the mold parts keeping the pipe centered.

After casting, the insertion of the connection may then be made. The bare end of the insulated lead is then soldered or brazed in the slot 40 to project just proud of the periphery of the slug part 23. The slug parts are partially assembled, and then inserted into the bottom of the hole.

With a two (2) inch or even larger anode, the diameter of the hole is preferably less than one (1) inch. For larger anodes, larger holes may be employed. The diameter of the hole may be, for example, about 0.75 inches in diameter and may vary from about 0.675 to about 1.250 inches. The diameter of the slug part is correspondingly smaller so they can be inserted to the bottom of the hole when partially assembled. The driving tool when mating with the socket 48 both rotates the bolt 46 and also exerts an axial force maintaining the one slug part 22 in the bottom or blind end of the hole. When the connection is tightened it forces the bare lead against the interior wall of the hole at the finished section. The tool is then removed and the hole 14 or 78 is filled with the potting compound 20 to form the complete anode such as seen in FIG. 1. The resulting anode is a solid cast iron anode which has a center electrical connection and is thus not vulnerable to the "end effect" or "pencil effect" failure. The full mass of the cast iron is thus available for use and provides not only a more economical to manufacture anode, but also one having a more effective longer service life.

To the accomplishment of the foregoing and related ends, the invention then comprises the features particularly pointed out in the claims, these being indicative, however, of but a few of the various ways in which the principles of the invention may be employed.

We claim:

1. A solid elongated cast iron anode having opposite ends, a small blind hole extending from one end to the approximate midpoint end-to-end of the anode, an electrical connection bottomed in said hole and wedged against a side wall of said hole at the bottom, an insulated lead secured to said connection and extending outwardly through said hole, and a potting dielectric compound filling said hole and sealing the connection within the midpoint of the anode with said insulated lead exiting the anode from said one end through said potting compound.

2. A solid cast iron anode as set forth in claim 1 wherein the diameter of the blind hole is less than about 1.250 inches.

3. A solid cast iron anode as set forth in claim 1 wherein the diameter of the blind hole is from about 0.675 to about 0.875 inches.

4. A solid cast iron anode as set forth in claim 1 wherein the diameter of the blind hole is about 0.75 inches.

5. A solid cast iron anode as set forth in claim 1 wherein said anode is cylindrical and has a diameter at least about 2 times the diameter of the blind hole.

6. A solid cast iron anode as set forth in claim 1 wherein said anode has a length end-to-end of in excess of two feet.

7. A solid cast iron anode as set forth in claim 1 wherein said anode has a length end-to-end of at least about four feet.

8. A solid cast iron anode as set forth in claim 1 wherein said anode has a length end-to-end of about five feet.

9. A solid cast iron anode as set forth in claim 1 wherein said electrical connection is a two part diagonally split slug, one part of which is bottomed in said blind hole.

10. A solid cast iron anode as set forth in claim 9 including a headed threaded bolt threaded in said one part and extending through a diametrically elongated slot in the other part.

11. A solid cast iron anode as set forth in claim 10 wherein said head of said bolt bears against said other part to drive the other part against the wall of the hole.

12. A solid cast iron anode as set forth in claim 11 including an external slot on said other part adapted to receive a bare end of said insulated lead for electrical connection, and to be driven against the wall of the hole when said bolt is tightened.

13. A solid cast iron anode as set forth in claim 12 including means to rotate said bolt to drive the lead against the wall of the hole, while axially urging the connection against the blind end of the hole.

14. A cast iron anode comprising a solid elongated cylindrical body, a blind hole formed in one end and terminating at about the midpoint of the anode, an electrical connection at the blind end of said hole with a lead extending outwardly through the hole, said connection comprising an expanded slug bottomed in said hole, and potting compound filling the hole to seal the electrical connection in the center of the body of the anode.

15. A cast iron anode as set forth in claim 14 wherein said slug is a two part diagonally split slug, and means to drive the two parts toward each other to expand the slug while exerting a force to maintain the connection bottom in the hole.

16. A method of making an elongated center connection solid cast iron anode having a blind hole in one end comprising the steps of positioning a center core in an elongated cylindrical mold, the core extending about half the length of the mold, casting iron into the mold with the core forming the blind hole, removing the casting from the mold, installing an electrical connection in the blind end of the hole, and filling the hole with a potting compound to form the anode.

17. A method as set forth in claim 16 including the step of using a two part diagonally split slug to form the connection, and using a threaded stud to drive the two parts along the diagonal split.

18. A method as set forth in claim 17 including the step of exerting both an axial and rotational force on said stud to force the connection against the blind end of the hole while driving the other of the two parts along the diagonal split.

19. A method as set forth in claim 18 including the step of securing the lead to the exterior of said outer part, and driving the lead against the wall of the hole.

20. A method as set forth in claim 19 wherein said anode is about five feet in length and said hole is less than about one and a quarter inch in diameter.

21. A method as set forth in claim 16 wherein said core is a shell core and is removed from the casting to form the blind hole before installation of the connection.

22. A method as set forth in claim 21 including the step of partially finishing the blind end of the hole to receive the connection when the core is removed.

23. A method as set forth in claim 16 wherein said core is a steel pipe left in place after casting.

24. A method as set forth in claim 23 wherein said steel pipe core is centered with chaplets.

25. A method as set forth in claim 24 wherein said chaplets have rings accommodating said steel pipe, and radial arms to obtain centering.

26. A method as set forth in claim 16 wherein said core projects from the end of the cast anode and is centered in the mold.

27. A method as set forth in claim 26 wherein the projecting end of the core is removed after casting and removal of the casting from the mold.

* * * * *